US006932189B2

(12) United States Patent
Helber et al.

(10) Patent No.: US 6,932,189 B2
(45) Date of Patent: Aug. 23, 2005

(54) DEVICE FOR NOISE STRUCTURING IN A MOTOR VEHICLE

(75) Inventors: Rolf Helber, Schorndorf (DE); Marcus Hofmann, Stuttgart (DE); Roudolf Starobinski, Hamburg (DE)

(73) Assignee: DaimlerChrysler Ag, Stuttgart (DE)

( * ) Notice: Subject to any disclaimer, the term of this patent is extended or adjusted under 35 U.S.C. 154(b) by 1 day.

(21) Appl. No.: 10/251,291

(22) Filed: Sep. 20, 2002

(65) Prior Publication Data

US 2003/0057015 A1 Mar. 27, 2003

(30) Foreign Application Priority Data

Sep. 24, 2001 (DE) ..... 101 46 840
May 22, 2002 (DE) ..... 102 22 507

(51) Int. Cl.[7] ..... F01N 7/10; F01N 7/08; F01N 1/16; F02M 35/12; F02M 35/16

(52) U.S. Cl. ..... 181/240; 181/238; 181/241; 181/253; 181/271; 181/219; 123/184.59

(58) Field of Search ..... 181/240, 212, 181/239, 238, 204, 196, 228, 227, 226, 237, 236, 241, 253, 254, 232, 271, 266, 250, 219, 273, 276; 123/184.57, 184.59; 180/309, 296, 68.3

(56) References Cited

U.S. PATENT DOCUMENTS 2,013,956 A * 9/1935 Heath ..... 181/262
3,505,983 A * 4/1970 Hartel ..... 123/184.59
3,685,615 A * 8/1972 Rutt ..... 181/232
3,687,224 A * 8/1972 Lundin ..... 181/207
4,154,058 A * 5/1979 Mase et al. ..... 60/293
4,497,288 A * 2/1985 Nakano et al. ..... 123/184.59
4,926,635 A * 5/1990 Sakuma ..... 181/236
4,972,921 A * 11/1990 Takada et al. ..... 181/240
5,005,533 A * 4/1991 Suzuki et al. ..... 123/184.59
5,351,481 A * 10/1994 Flugger ..... 181/238

FOREIGN PATENT DOCUMENTS

| | | | | |
|---|---|---|---|---|
| DE | 41 40 429 | | 6/1993 | |
| DE | 42 33 252 | | 12/1993 | |
| DE | 44 35 296 | | 4/1996 | |
| DE | 44 39 705 | | 5/1996 | |
| DE | 197 04 376 | | 8/1998 | |
| DE | 10212257 | A1 * | 9/2002 | ..... B60Q/9/00 |
| DE | 10223871 | A1 * | 12/2003 | ..... B60K/13/04 |
| DE | 10223872 | A1 * | 12/2003 | ..... B60Q/5/00 |
| DE | 10223873 | A1 * | 12/2003 | ..... B60Q/5/00 |
| DE | 10223875 | A1 * | 12/2003 | ..... B60Q/5/00 |
| EP | 0 335 941 | | 9/1993 | |
| GB | 2136501 | A * | 9/1984 | ..... F02B/27/00 |
| JP | 57148024 | A * | 9/1982 | ..... F02B/27/02 |
| JP | 58091328 | A * | 5/1983 | ..... F02B/33/00 |
| JP | 59039926 | A * | 3/1984 | ..... F02B/27/02 |
| JP | 02099711 | A * | 4/1990 | ..... F01N/7/04 |

* cited by examiner

*Primary Examiner*—Edgardo San Martin
(74) *Attorney, Agent, or Firm*—Kenyon & Kenyon

(57) ABSTRACT

A device for noise structuring in a motor vehicle has a plurality of gas-carrying lines connected to an internal combustion engine. At least two of the gas-carrying lines are acoustically linked together by at least one connection.

23 Claims, 3 Drawing Sheets

DEVICE FOR NOISE STRUCTURING IN A MOTOR VEHICLE

CROSS-REFERENCE TO RELATED APPLICATIONS

The present application claims priority to Application No. 101 46 840.7, filed in the Federal Republic of Germany on Sep. 24, 2001, and Application No. 102 22 507.9, filed in the Federal Republic of Germany on May 22, 2002, each of which is expressly incorporated herein in its entirety by reference thereto.

FIELD OF THE INVENTION

The present invention relates to a device for noise structuring in a motor vehicle having a plurality of gas-carrying lines connected to an internal combustion engine.

BACKGROUND INFORMATION

Advancements in acoustics technology mean that motor vehicles of recent design, in particular vehicles in the luxury and sports car class, are distinguished by a high level of comfort in terms of sound insulation in the passenger compartment of the vehicle. This high comfort level is here characterized by a low sound pressure level and by largely suppressed background noise. This is also true of the external noise generated by the motor vehicle, particularly in respect of the statutory regulations, according to which, in the Federal Republic of Germany, for example, a maximum sound pressure level of 74 dB(A) is permitted.

The increasingly emotive considerations attached to the use of the aforementioned vehicles and the decision to purchase them make it more important to purposely structure the internal and external noise of the motor vehicle to suit the particular type of vehicle.

Since vehicles in the luxury and sports car class have a low interior sound pressure level, it is often relatively difficult for the driver to distinguish the instantaneous load of the internal combustion engine fitted in the vehicle solely from the engine noise prevailing in the vehicle passenger compartment. This is often desirable, however, particularly in the case of sports cars, since it may be precisely these vehicles in which subjective perceptions on the part of the driver play a part in the use or in the purchase of such a vehicle.

In order to provide the driver the facility for detecting the engine load from the engine noise while underway, measures may be implemented in the sound absorption system, which can mean an increase in the external noise level. This often results in considerable noise pollution to the immediate surroundings and the wider environment. Furthermore, under statutory provisions the external noise level may be increased only to a very limited extent.

The problems described above are known, and German Published Patent Application No. 197 04 376 describes a means of acoustically connecting the filter housing of an air filter arrangement for an internal combustion engine of a motor vehicle to the passenger compartment of the motor vehicle by way of a line.

German Published Patent Application No. 42 33 252 describes a motor vehicle in which a main line from an intake or exhaust system is connected by way of a line to the passenger compartment. A diaphragm is arranged in the area where the line opens into the passenger compartment and a throttle valve adjustable as a function of an accelerator pedal is arranged between the diaphragm and the main line.

German Published Patent Application No. 44 35 296 describes a motor vehicle having an internal combustion engine, in which the intention is to improve the arrangement described in German Published Patent Application No. 42 33 252. For this purpose a pipe, which is provided with at least one acoustic resonator, adjoins the diaphragm on the side remote from the tubular section.

All of the conventional solutions operate solely with the noises generated by the internal combustion engine, which although they may be amplified and/or fed into the passenger compartment of the motor vehicle by the said measures are not susceptible to influencing or modification of the noise.

It is therefore an object of the present invention to provide a device for noise structuring in a motor vehicle, which by the simplest possible arrangement creates various, desired sound characteristics for the vehicle.

SUMMARY

The above and other beneficial objects of the present invention are achieved by providing a device as described herein.

In accordance with at least one connection provided for according to the present invention, which acoustically links at least two of the gas-carrying lines of the internal combustion engine together, it is possible to vary the intake and/or exhaust noise of the internal combustion engine by amplifying or eliminating individual engine orders, i.e., sound frequencies varying as a function of the speed of the internal combustion engine.

A very sporty sound to the motor vehicle may thereby be generated, as desired, without having to exceed certain limits of the permitted sound pressure level.

In an example embodiment of the present invention that may be particularly easy to implement, at least one connection may be configured as a connecting line. Alternatively, it is also possible to configure the connection as a hollow body.

In order to eliminate or amplify specific frequencies, in an example embodiment of the present invention, at least one connecting line may link at least two gas-carrying lines together so that travel time differences for sound waves propagated in the gas-carrying lines are produced between the two gas-carrying lines.

An amplification of the sound generated by the connecting line according to the present invention may be achieved if at least one hollow body is fitted in the connecting line.

The noise generated may be further influenced or modified if at least two lines, which open into a passenger compartment of the vehicle at different points, proceed from the hollow body. This example embodiment may be used with widely varying types of hollow body.

Further aspects of the present invention are described below with reference to the drawings.

DETAILED DESCRIPTION

Figure 1:
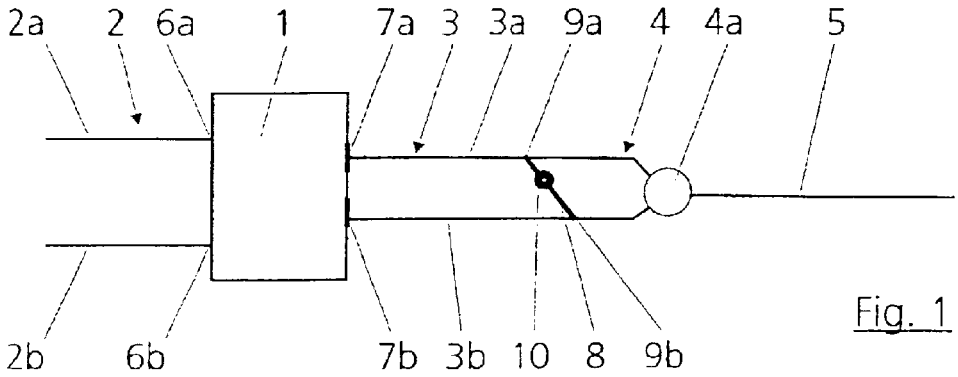
FIG. 1 is a schematic view of a device according to the present invention for noise structuring in a motor vehicle.

FIG. 1 schematically illustrates an internal combustion engine 1 of a motor vehicle. Connected to the internal combustion engine 1 are gas-carrying lines 2 and 3, the intake lines 2*a* and 2*b* leading to the internal combustion engine 1 and the exhaust lines 3*a* and 3*b* leading away therefrom. The exhaust lines 3*a* and 3*b* form an exhaust manifold 4, which opens at an opening point 4*a* into an exhaust pipe 5.

The intake lines 2*a* and 2*b* are connected to the internal combustion engine 1 at connecting points 6*a* and 6*b*. The exhaust lines 3*a* and 3*b* are similarly connected to the internal combustion engine 1 at connecting points 7*a* and 7*b*. The two exhaust lines 3*a* and 3*b* are acoustically linked to one another by a connection configured as connecting line 8. The connecting line 8 therefore also has connecting points 9*a*, 9*b*, the connecting line 8 connected to the exhaust line 3*a* at the connecting point 9*a* and the connecting line 8 being linked to the exhaust line 3*b* at the connecting point 9*b*. By the connecting line 8 described, it is possible to influence the noise generated by the internal combustion engine 1, which is propagated through the gas-carrying lines 2 and 3 in the form of sound waves, so that the desired noise is produced. This may be achieved, for example, by amplifying or by eliminating individual engine orders.

In this instance the connecting points 9*a* and 9*b* between the connecting line 8 and the two exhaust lines 3*a* and 3*b* are arranged at different distances from respectively associated connecting points 7*a* and 7*b*, at which the exhaust lines 3*a* and 3*b* are connected to the internal combustion engine 1. This represents a facility for generating travel time differences between the two exhaust lines 3*a* and 3*b* for sound waves propagated in the exhaust lines 3*a* and 3*b*. Thus different engine orders, i.e., the multiples of specific resonance frequencies of the internal combustion engine 1, may be amplified or eliminated, so that a characteristic sound of the internal combustion engine 1 is generated.

In contrast to the representation, the connecting line 8 has a considerably smaller cross section than the two gas-carrying lines 2 and 3, in order to prevent any transfer of exhaust gases through the connecting line 8.

Figure 2:
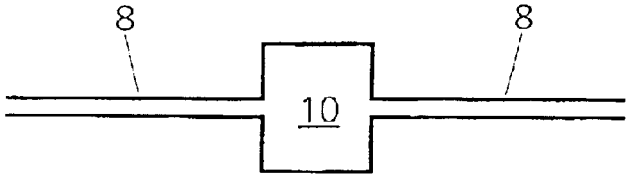
FIG. 2 is an enlarged schematic view of the connecting line illustrated in FIG. 1 having a hollow body arranged therein.

In this instance a hollow body 10, which is illustrated in FIG. 2, is arranged in the connecting line 8. The hollow body 10 amplifies the noise generated by the connecting line 8 and in this manner serves, so to speak, as "loudspeaker" or as "amplifier".

Figure 3:
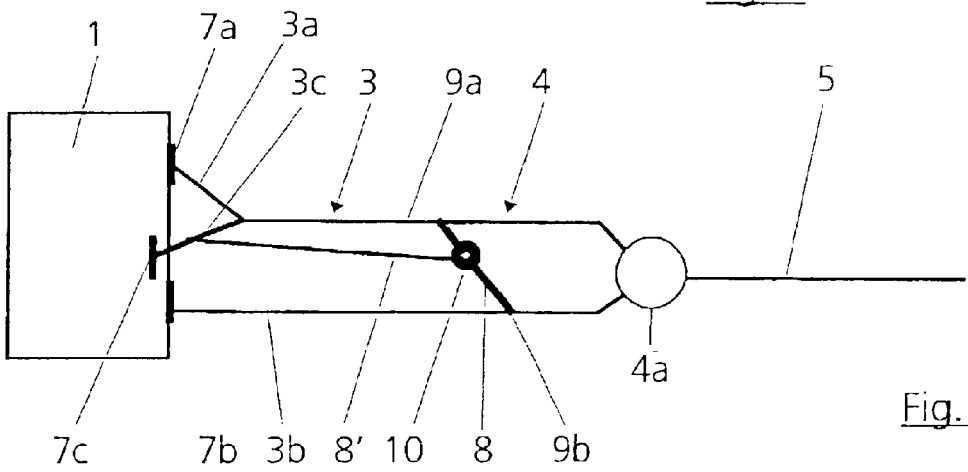
FIG. 3 is a schematic view of an alternative example embodiment of the device illustrated in FIG. 1.

FIG. 3 illustrates an internal combustion engine 1, which in addition to the two exhaust lines 3*a* and 3*b* has a third exhaust line 3*c*. Intake lines 2 are also provided. In this case a further connecting line 8' is provided from the third exhaust line 3*c* to the hollow body 10 in the first connecting line 8. This further connecting line 8' may also open into the connecting line 8 at an entirely different point, for example, if no hollow body 10 were provided.

In this context an entirely different linking of the exhaust lines 3*a*, 3*b* and 3*c* by a greater number of connecting lines 8 is also possible. In the same manner it is also possible to link the intake lines 2*a*, 2*b* and 2*c* together instead of the exhaust lines 3*a*, 3*b* and 3*c*. It is moreover possible to link the exhaust lines 3*a*, 3*b* and 3*c* to the intake lines 2*a*, 2*b* and 2*c*, in which case any number of connecting lines 8 may be used. The number and the arrangement of the connecting lines 8 depends on the noise which it is intended to generate through the connecting lines 8 and any hollow body 10.

Figure 4:
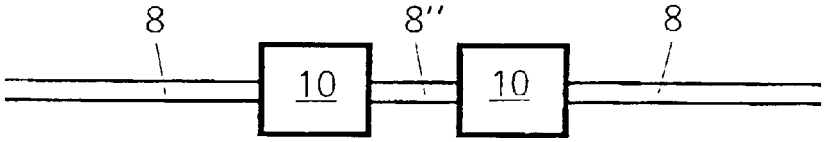
FIG. 4 is a schematic view of an alternative example embodiment of the connecting line illustrated in FIG. 2 having two hollow bodies arranged therein.

FIG. 4 illustrates a further example embodiment of the connecting line 8 in which, in this case, two hollow bodies 10 are arranged. A connecting line 8", which is part of the connecting line 8, extends between the hollow bodies 10. A different noise structure may be achieved by this arrangement.

Figure 5:
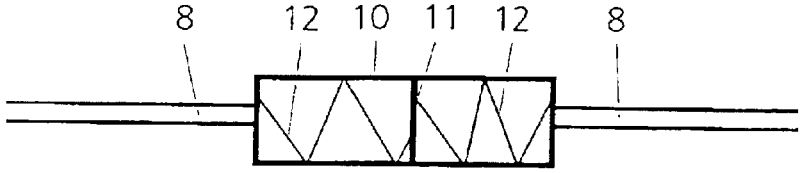
FIG. 5 is a schematic view of an alternative example embodiment of the hollow body arranged in the connecting line.

FIG. 5 illustrates an alternative example embodiment of the hollow body 10. In this case an oscillatable element 11, which may be configured as a gas-impermeable membrane, for example, is arranged inside the hollow body 10. The oscillatable element 11 amplifies the noise propagated in the gas-carrying lines 2 and 3. In the example embodiment illustrated the oscillatable element 11 is supported by two spring elements 12 permitting a free displacement of the oscillatable element 11, so that it may oscillate in the hollow body 10.

Figure 6:
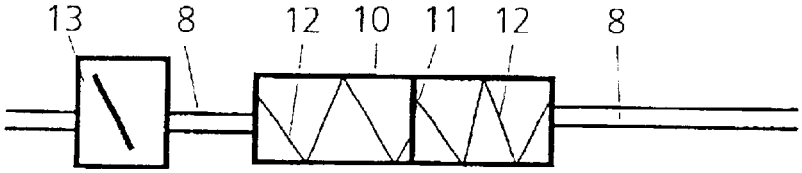
FIG. 6 is a schematic view of a further alternative example embodiment of the hollow body arranged in the connecting line.
Figure 7:
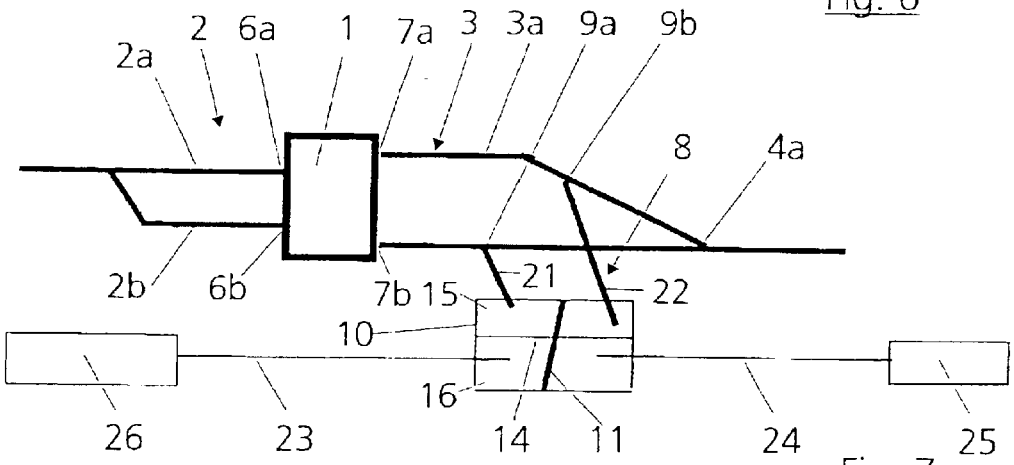
FIG. 7 is a schematic view of a further example embodiment of the device according to the present invention for noise structuring in a motor vehicle.

FIG. 6 illustrates the hollow body illustrated in FIG. 5 with the oscillatable element 11 arranged therein and the two spring elements 12. A component configured as throttle valve 13 for varying the cross-section of the connecting line 8 is fitted in the connecting line 8 upstream or downstream of the hollow body 10, the component being capable of opening or closing the connecting line 8 as a function of the speed of the internal combustion engine 1, for example, so that the sound of the internal combustion engine 1 is modified only in specific speed ranges, whereas in other speed ranges the sound remains unchanged.

FIGS. 7 to 10 illustrate the hollow body 10 connected to one or more connecting lines 8, 8', 8" . . . in various attachments to the gas-carrying lines 2 and 3 and in various example embodiments.

Figure 8:
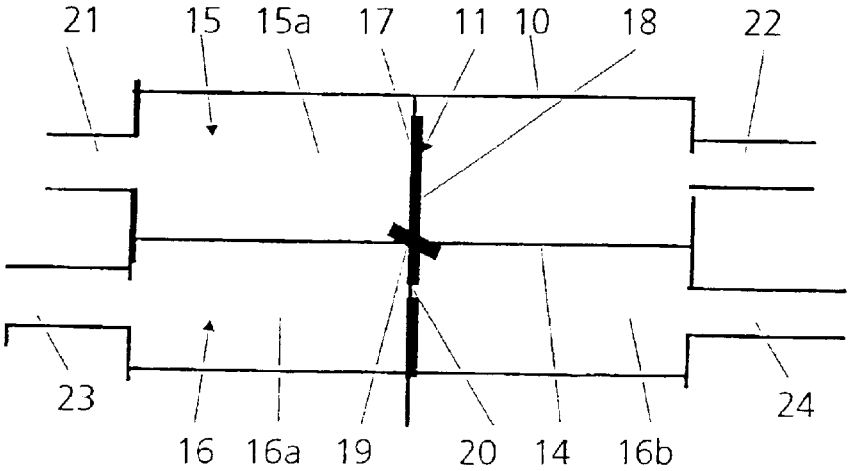
FIG. 8 is a schematic view of a device for amplifying the noise generated by the internal combustion engine, arranged in the hollow body arranged in the connecting line.

Besides the oscillatable element 11, the hollow bodies 10 illustrated in FIGS. 7, 8, 9 and 10 have an acoustically inert wall 14 which divides the hollow body 10 into two chambers 15 and 16. In this case the chamber 15 is an inlet-side chamber and the chamber 16 is an outlet-side chamber. The wall 14 prevents the sound waves entering the chamber 15 being able to pass into the other chamber 16. This transmission is brought about solely by the oscillatable element 11, which as illustrated in FIG. 8 has a thin, elastic membrane 17 and a plate 18 fitted to the elastic membrane, which plate may be of sandwich construction, for example, and provided with a coating. The plate 18 may have any other suitable lightweight construction instead of the sandwich construction. The crucial aspect is a low weight with simultaneously high rigidity of the plate 18.

The oscillatable element 11 is supported on a pivot 19, which in this instance is formed by the point of intersection of the oscillatable element 11 with the wall 14. The sound occurring in the chamber 15 is carried into the chamber 16 by the oscillation of the element 11 about the pivot 19. The membrane 17 amplifies these sound waves due, on the one hand, to its elasticity and on the other to the fact that the presence of the membrane 17 allows a greater pressure to be built up in the chamber 15, which culminates in an oscillatable element 11 of larger arrangement. The plate 18 is of as rigid a construction as possible, so that it only performs oscillations about its pivot 19 that are caused by the sound pressure, and so that minimal transient oscillations of the plate 18 occur. At the same time the plate 18 may be as light as possible, in order to permit an acceleration thereof even under slight forces. It is also possible to configure the plate 18 so that its eigenmodes are purposely exploited in the oscillation, for example by a softer or harder configuration of the plate 18.

The oscillatable element 11 divides each of the two chambers 15 and 16 into sub-chambers 15*a* and 15*b* and 16*a* and 16*b*. To compensate for pressure differences between the sub-chambers 16*a* and 16*b*, these are in this case connected to one another by a hole 20 made through the plate 18. It is also possible to connect the two sub-chambers 15*a* and 15*b* together.

In this instance lines 21, 22, 23 and 24 are arranged both to the sub-chambers 15*a* and 15*b* and to the sub-chambers 16*a* and 16*b* respectively, of which at least the lines 21 and 22 are connected to the gas-carrying lines 2 and 3 respectively and thus represent a part of the connecting line 8. The line 24 proceeding from the sub-chamber 16*b* is in this instance connected to an inner chamber 25 and/or to the engine compartment of the motor vehicle. The line 23 proceeding from the sub-chamber 16*a*, on the other hand, is acoustically linked to a chamber 26 surrounding the motor vehicle. In this manner the sound waves amplified by the oscillatable element 11 are transmitted to the corresponding points, so that the driver and/or any other persons receive information on the load of the internal combustion engine 1.

As an alternative to this, the lines 23 and 24 may also be connected to the gas-carrying lines 2 and/or 3. Furthermore, even more lines 23 and 24 may proceed from the chamber 16 to the inside chamber 25, to the chamber 26 and/or to the gas-carrying lines 2 and 3.

It is also possible in this context to lead the lines 23 and 24 to two different points in the passenger compartment 25 of the motor vehicle, it being possible to influence or modify the noise generated in the passenger compartment 25 in that the two lines 23 and 24 and any further lines have different lengths, resulting in interferences. Through appropriate layout of the lines 23 and 24 it is thereby possible to positively influence the sound pattern, various frequencies being damped or entirely eliminated and other frequencies being amplified.

Figure 9:
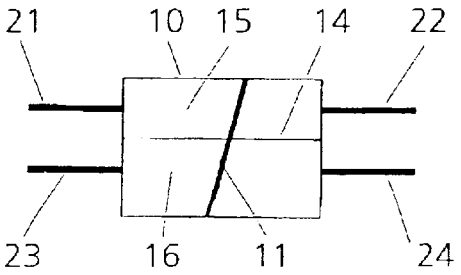
FIG. 9 is a schematic view of a further device for amplifying the noise generated by the internal combustion engine, arranged in the hollow body arranged in the connecting line.
Figure 10:
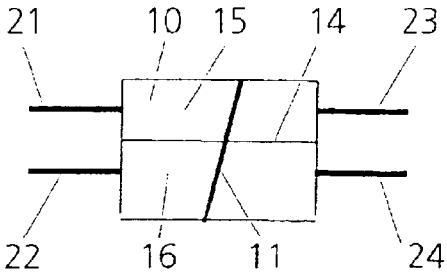
FIG. 10 is a schematic view of a further device for amplifying the noise generated by the internal combustion engine, arranged in the hollow body arranged in the connecting line.

Two different possibilities for the arrangement of the hollow body 10 are illustrated in FIGS. 9 and 10. In the example embodiments illustrated in FIG. 9 and FIG. 10 the static forces or pressures are balanced by the oscillatable element 11.

In the example embodiment illustrated in FIG. 10, the lines 21 and 22 open into the hollow body 10 on both sides of the acoustically inert wall 14 and are statically balanced by the oscillatable element 11.

Figure 11:
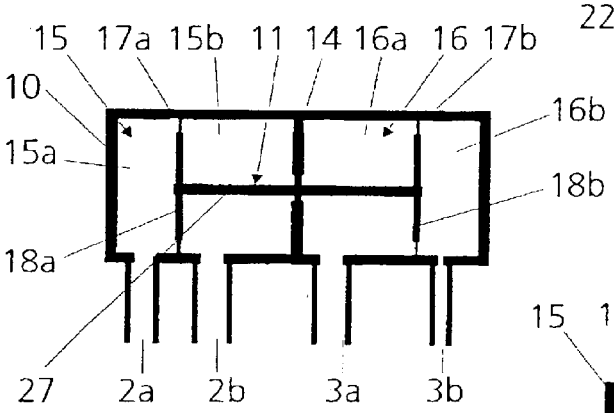
FIG. 11 is a schematic view of a first example embodiment of a hollow body connecting two gas-carrying lines together.
Figure 12:
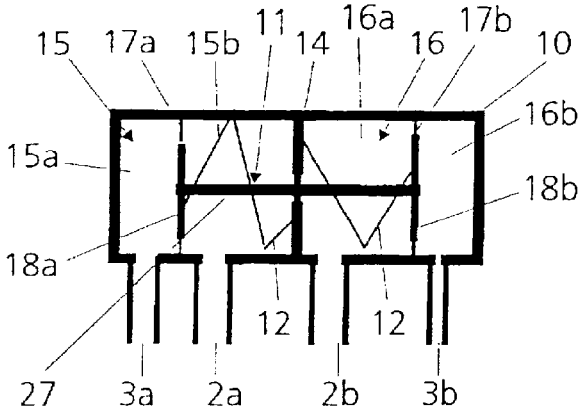
FIG. 12 is a schematic view of a second example embodiment of a hollow body connecting two gas-carrying lines together.
Figure 13:
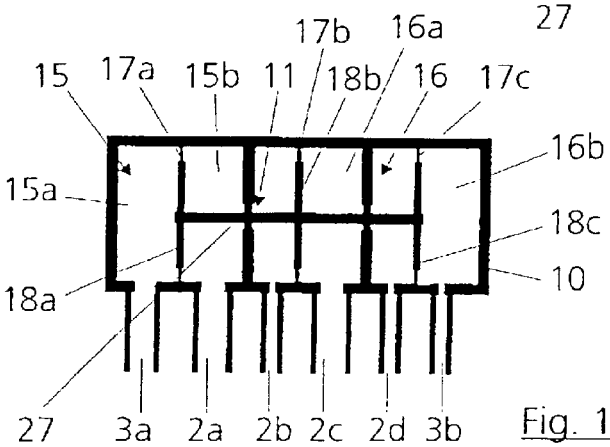
FIG. 13 is a schematic view of a third example embodiment of a hollow body connecting two gas-carrying lines together.

FIGS. 11, 12 and 13 illustrate another example embodiment of the hollow body 10, in which the hollow body 10 directly forms the connection between the gas-carrying lines 2 and 3, so that an acoustic link is formed as described above.

In this exemplary embodiment the oscillatable element 11 furthermore has two plates 18*a* and 18*b* connected by a connecting element 27 in the form of a rod, which is as light and at the same time as rigid as possible. The two plates 18*a* and 18*b* are in each case arranged on membranes 17*a* and 17*b*, which are fixed to the hollow body 10. In this manner the oscillatable element 11 may perform oscillatory movements in the axial direction of the hollow body 10. If necessary, the membranes 17*a* and 17*b* may also be dispensed with and the oscillatable element 11 may then be formed solely by the plates 18*a* and 18*b*.

The connecting element 27 is in each case led through one or two acoustically inert walls 14 also provided.

In the example embodiment illustrated in FIG. 11 the two sub-chambers 15*a* and 15*b* also provided are connected to the intake lines 2*a* and 2*b*, and the sub-chambers 16*a* and 16*b* are connected to the exhaust lines 3*a* and 3*b*, so that a balancing of the static forces and static pressures is achieved.

In attaching the hollow body 10 to the gas-carrying lines 2 and 3 illustrated in FIG. 12, this static balance is provided by the connecting element 27 of the oscillatable element 11. The exhaust lines 3*a* and 3*b* are connected to the sub-chambers 15*a* and 16*b*, whereas the intake lines 2*a* and 2*b* open into the sub-chambers 15*b* and 16*a*. Furthermore, the two spring elements 12 supporting the elasticity of the membranes 17*a* and 17*b* are also provided.

If, as illustrated in FIG. 13, a total of four intake lines 2*a*, 2*b*, 2*c* and 2*d* are provided, the oscillatable element 11 may have a total of three of the membranes 17*a*, 17*b*, 17*c* with associated plates 18*a*, 18*b* and 18*c*, which separate the individual gas-carrying lines 2 and 3 from one another and thus divide the chambers 15 and 16 into an even greater number of sub-chambers.

In all of the example embodiments illustrated in FIGS. 11, 12 and 13, the plates 18*a*, 18*b* and possibly 18*c* assigned to the connecting elements 27 are in each case provided in a number and arrangement such that the static pressures introduced into the hollow body 10 via the lines 2 and 3 are balanced out. For this purpose a corresponding arrangement of the plates 18*a*, 18*b* and 18*c* in relation to the lines 2 and 3 may be required. In other words, at least two of the plates 18*a*, 18*b* and 18*c* are arranged so that the oscillatable element 11 acted upon by the pressures introduced via the lines 2*a*, 2*b*, 2*c*, 2*d*, 3*a*, 3*b* is statically balanced.

What is claimed is:

1. A device for noise structuring in a motor vehicle, comprising:

a plurality of gas-carrying lines connected to an internal combustion engine; and at least one connection, at least two of the gas-carrying lines acoustically linked together by the connection, the connection configured to vary at least one of an intake and exhaust noise of a motor vehicle engine by one of amplifying and eliminating sound frequencies varying as a function of a speed of the engine;

wherein the at least two of the gas-carrying lines acoustically linked together by the connection include at least one intake line.

2. The device according to claim 1, wherein the connection includes a connecting line.

3. A device for noise structuring in a motor vehicle, comprising:

a plurality of gas-carrying lines connected to an internal combustion engine; and at least one connection, at least two of the gas-carrying lines acoustically linked together by the connection;

wherein the connection includes a connecting line; and wherein at least one connecting line links at least two gas-carrying lines together so that travel time differences for sound waves propagated in the gas-carrying lines are produced between the two gas-carrying lines.

4. A device for noise structuring in a motor vehicle, comprising:

a plurality of gas-carrying lines connected to an internal combustion engine; and at least one connection, at least two of the gas-carrying lines acoustically linked together by the connection;

wherein the connection includes a connecting line; and wherein connecting points between at least one connecting line and at least two gas-carrying lines are arranged at different distances from associated connecting points at which the gas-carrying lines are connected to the internal combustion engine.

5. A device for noise structuring in a motor vehicle, comprising:

a plurality of gas-carrying lines connected to an internal combustion engine; and at least one connection, at least two of the gas-carrying lines acoustically linked together by the connection, the connection configured to vary at least one of an intake and exhaust noise of a motor vehicle engine by one of amplifying and eliminating sound frequencies varying as a function of a speed of the engine;

wherein the connection includes a connecting line; and wherein the connecting line has a considerably smaller cross-section than the gas-carrying line.

6. The device according to claim 2, further comprising at least one hollow body arranged in the connecting line.

7. The device according to claim 1, wherein at least one connection is configured as a hollow body.

8. A device for noise structuring in a motor vehicle, comprising:

a plurality of gas-carrying lines connected to an internal combustion engine;

at least one connection, at least two of the gas-carrying lines acoustically linked together by the connection, the connection configured to vary at least one of an intake and exhaust noise of a motor vehicle engine by one of amplifying and eliminating sound frequencies varying as a function of a speed of the engine, the connection including a connecting line;

at least one hollow body arranged in the connecting line; and an oscillatable element arranged inside the hollow body.

9. The device according to claim 8, wherein the oscillatable element includes a membrane.

10. The device according to claim 8, further comprising a spring element configured to support the oscillatable element so that the oscillatable element is oscillatable in the hollow body.

11. A device for noise structuring in a motor vehicle, comprising:

a plurality of gas-carrying lines connected to an internal combustion engine; and at least one connection, at least two of the gas-carrying lines acoustically linked together by the connection, the connection including a connecting line; and at least one hollow body arranged in the connecting line;

wherein the hollow body includes an essentially acoustically inert wall that divides the hollow body into two chambers, an oscillatable element extending into both of the two chambers.

12. The device according to claim 11, wherein one of at least two chambers of the hollow body is linked by a tubular line part to at least one of the gas-carrying lines, and at least one other chamber is at least one of linked by at least one line at least one of to at least one of an internal chamber and an engine compartment of the motor vehicle and to at least one of the gas-carrying lines and acoustically linked to a chamber surrounding the motor vehicle.

13. A device for noise structuring in a motor vehicle, comprising:

a plurality of gas-carrying lines connected to an internal combustion engine;

at least one connection, at least two of the gas-carrying lines acoustically linked together by the connection, the connection including a connecting line; and an arrangement configured to selectively vary a cross-section of the connecting line arranged inside at least one connecting line.

14. The device according to claim 1, wherein the gas-carrying lines include a plurality of intake lines of the internal combustion engine.

15. The device according to claim 1, wherein the gas-carrying lines acoustically linked together by the connection include at least one exhaust line of the internal combustion engine.

16. A device for noise structuring in a motor vehicle, comprising:

a plurality of gas-carrying lines connected to an internal combustion engine; and at least one connection, at least two of the gas-carrying lines acoustically linked together by the connection, the connection including a connecting line;

at least one hollow body arranged in the connecting line; and an oscillatable element arranged inside the hollow body;

wherein the oscillatable element includes at least two plates arranged on a connecting element.

17. The device according to claim 16, wherein the at least two plates are each supported on the hollow body by membranes.

18. The device according to claim 16 wherein the at least two plates are arranged so that the oscillatable element acted upon by pressures introduced by the lines is statically balanced.

19. A device for noise structuring in a motor vehicle, comprising:

a plurality of gas-carrying lines connected to an internal combustion engine; and at least one connection, at least two of the gas-carrying lines acoustically linked together by the connection, the connection including a connecting line;

at least one hollow body arranged in the connecting line;

wherein at least two lines, which open into a passenger compartment of the motor vehicle, at different points, proceed from the hollow body.

20. The device according to claim 19, wherein the two lines have different lengths.

21. The device according to claim 1, wherein the gas-carrying lines include at least a first line and a second line, the first line connected on one end at a first connection point on the internal combustion engine, the second line connected on one end at a second connection point on the internal combustion engine.

22. A device for noise structuring in a motor vehicle, comprising:

a plurality of gas-carrying lines connected to an internal combustion engine; and at least one connection, at least two of the gas-carrying lines acoustically linked together by the connection, the connection configured to vary at least one of an intake and exhaust noise of a motor vehicle engine by one of amplifying and eliminating sound frequencies varying as a function of a speed of the engine;

wherein the gas-carrying lines include at least a first line and a second line, the first line connected on one end at a first connection point on the internal combustion engine, the second line connected on one end at a second connection point on the internal combustion engine; and wherein the gas-carrying lines include a plurality of intake lines and a plurality of exhaust lines, at least one intake line connected to at least one exhaust line via the connection.

23. The device according to claim 13, wherein the arrangement includes a throttle valve.

* * * * *